United States Patent [19]

Miki et al.

[11] Patent Number: 4,744,738

[45] Date of Patent: May 17, 1988

[54] GEAR PUMP OR MOTOR WITH HARD LAYER IN INTERIOR CASING SURFACE

[75] Inventors: Masayuki Miki, Otsu; Kyoji Sera, Joyo, both of Japan

[73] Assignee: Shimadzu Corporation, Kyoto, Japan

[21] Appl. No.: 65,110

[22] Filed: Jun. 23, 1987

Related U.S. Application Data

[63] Continuation of Ser. No. 784,643, Oct. 4, 1985, abandoned.

[30] Foreign Application Priority Data

Oct. 8, 1984 [JP] Japan ..... 59-212139
Feb. 28, 1985 [JP] Japan ..... 60-40713

[51] Int. Cl.[4] ..... F04C 2/18; F04C 2/10; F04C 15/00

[52] U.S. Cl. ..... 418/126; 418/170; 418/178; 418/179; 418/206

[58] Field of Search ..... 418/152, 178, 179, 126, 418/120, 205, 206; 29/156, 4 R

[56] References Cited

U.S. PATENT DOCUMENTS

| | | | |
|---|---|---|---|
| 2,126,200 | 8/1938 | Linderman | 418/178 |
| 2,519,588 | 8/1950 | McCulloch | 418/178 |
| 3,268,949 | 8/1966 | Schmidt et al. | 418/178 |
| 3,483,825 | 12/1969 | Difford et al. | 418/178 |
| 3,554,677 | 1/1971 | Zapf et al. | 418/178 |
| 3,712,767 | 1/1973 | Beutter | 418/179 |
| 4,137,023 | 1/1979 | Moked et al. | 418/178 |
| 4,253,808 | 3/1981 | White | 418/126 |

FOREIGN PATENT DOCUMENTS

| | | | |
|---|---|---|---|
| 2056661 | 5/1972 | Fed. Rep. of Germany | 418/178 |
| 2165339 | 7/1973 | Fed. Rep. of Germany | 418/152 |
| 51-86014 | 7/1976 | Japan | 418/178 |
| 58-67989 | 4/1983 | Japan | 418/178 |
| 2120728 | 12/1983 | United Kingdom | 418/178 |

*Primary Examiner*—John J. Vrablik
*Attorney, Agent, or Firm*—Birch, Stewart, Kolasch & Birch

[57] ABSTRACT

A gear pump or motor comprises a pair of gears intermeshing with each other, a case body accommodating the pair of gears, and a hard layer formed on an inner surface of the case body. The hard layer is made of a material to be as hard as not to be cut by tooth tips of the pair of gears. The hard layer may be a ceramic coating or a composite coating layer which performs a grinding like operation on the tooth tips.

11 Claims, 6 Drawing Sheets

FIG. 9
PRIOR ART
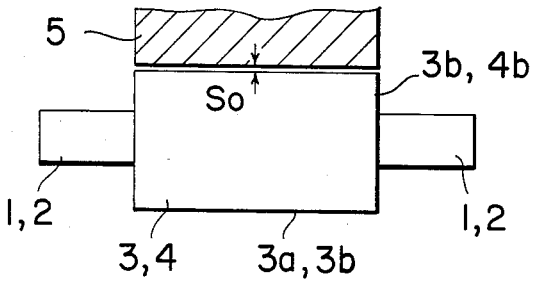
FIG. 10
PRIOR ART
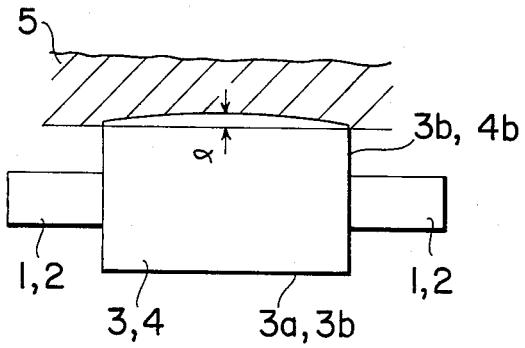
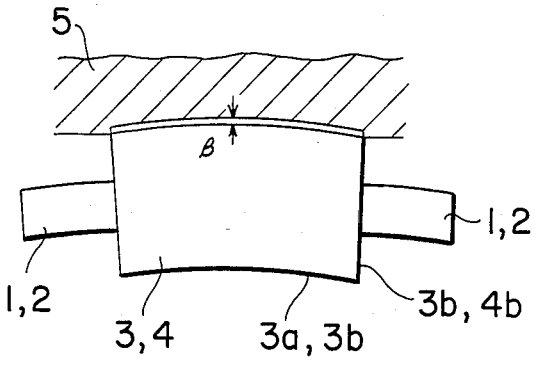
FIG. 11
PRIOR ART
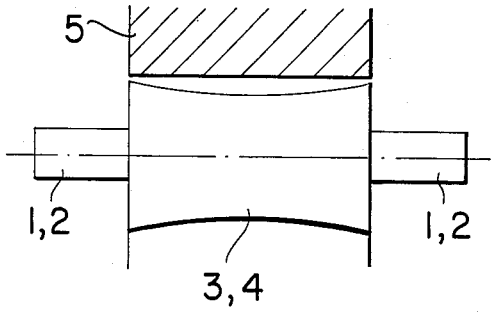
FIG. 13

GEAR PUMP OR MOTOR WITH HARD LAYER IN INTERIOR CASING SURFACE

This application is a continuation of application Ser. No. 784,643, filed on Oct. 4, 1985, now abandoned.

BACKGROUND OF THE INVENTION

The present invention relates to a gear pump or motor with high volumetric pump efficiency and, more particularly, to a gear pump or motor having an excellent oil seal between the gears and the housing.

Conventionally, a gear pump or motor comprises a pair of intermeshing rotatable gears mounted within a casing or housing. When one of the gears coupled to a main shaft is driven, oil will be fed from one port adjacent the intermeshing gears and exhausted out another port adjacent the intermeshing gears. This arrangement functions as a gear pump. When one port is connected to a high pressure oil supply and the other port receives oil at a lower pressure, the oil under pressure will be transmitted from a high pressure inlet to a low pressure outlet, thus driving the pair of gears. This mode functions as a motor in which the main shaft is rotated as an output shaft.

FIGS. 4 and 5 show a known construction of such a gear pump or motor in the mode of a gear pump, by way of example. A main shaft 1 and a follower shaft 2 are coupled to a pair of intermeshing spur gears 3 and 4, respectively. The gears 3 and 4 are contained within a casing 5 and positioned such that the tips of the teeth of the gears 3 and 4 slide on the inner surface of the casing 5. The main shaft 1 and the follower shaft 2 are rotatably mounted in bearings 8 and 9, respectively, disposed on a front cover 6 and a rear cover 7. Side plates 10 and 11 are interposed between the gears 3 and 4, and the front cover 6 and the rear cover 7 to stop oil leakage through the sides of the gears 3 and 4. In such an arrangement, when the main shaft 1 is rotated counterclockwise by a motor (not shown), oil will be fed from a low pressure port 12 adjacent a meshing area of the gears 3 and 4 and exhausted into a high pressure port 13 at the opposing meshing area of the gears 3 and 4 to thereby serve as a pump.

Conventionally, except where the ports are located, the gear tips and the sides of the gears 3 and 4 slide on the inner surfaces of the casing 5 and the side plates 10 and 11, respectively, so as to provide a small clearance therebetween which contains an oil layer. Thus, oil will be prevented from leaking around the gear teeth tips and the sides of the gears. In other words, the amount of oil leaking through the space formed between the meshing teeth of the gears 3 and 4, and between the side plates 10 and 11 and the gear sides will be minimized by providing an appropriate clearance between the gear teeth tips and the casing. To increase the efficiency of the gear pump or motor, the oil seal must be as small as possible at the sliding surfaces and is provided by selecting the necessary and the minimum clearance. Where the gear pump is operated as a high pressure pump, as in its recent wide use, since the oil exhaustion pressure increases, in particular in the high pressure pump, the leakage of the inner oil increases. If the oil seal is not sufficient between the sliding elements, the volumetric pump efficiency can be remarkably reduced during high pressure and temperature operation.

To manufacture a gear pump or motor in a known manner, in particular one suitable for use as a high pressure pump, the machining accuracy used in making the casing, the side plates, the bearings, the gears and the other components should be raised and these elements should be properly and selectively combined. In other words, to raise the machining and assembling measurement accuracy, it is necessary to provide the appropriate clearance between the gears and the peripheral walls of the casing. In particular, the inner diameter of the casing body is originally a little small so that a "running-in-operation" prior to the actual use of the device is conducted after the pump has been assembled. During the "running-in-operation", the inner surface of the casing body is cut by the hard tooth tips of the gears, whereby the clearance between the casing body surface and the tooth tips of the gear is adjusted. Even if there is some measurement error in the gear pump elements, the tooth tips of the gears will cut the inner surface of the case body, so as to automatically produce the appropriate clearance. Further, though the center of the gears may be deflected somewhat due to the pressure difference between the high pressure side and the low pressure side of the pump, the inner cutting of the casing by the gear teeth tips can effectively account for the deflection.

In this manner, the oil leakage from the high pressure side to the low pressure side of the pump can be prevented by the sliding between the cut inner surface of the casing 5 adjacent the low pressure port 12 and the tooth tips of the gears 3 and 4.

However, providing a clearance for oil sealing by cutting the casing has the disadvantage that when the operative condition of the gear pump or motor changes, in particular, the rotation speed and the temperature, the oil leakage at the gear teeth tips of the gears can be remarkably increased to thereby reduce the capacity or efficiency of the gear pump or motor. When the material of the casing 5 is a cast iron, the cutting face may be rough to thereby lower the seal efficiency and the volumetric pump efficiency of the gear pump or motor.

The present inventors find the following reasons why the oil leakage can increase when there is a change in the operation conditions. Where the oil seal is provided by cutting the inner surface of the casing, the lifting height of the shafts 1 and 2 due to the oil layer in the clearance is relatively small and the gears 3 and 4 are stressed to the low pressure side from the high pressure side. Therefore, as shown in FIG. 6, a center Og1 of each of the gears 3 and 4 is shifted by an amount equal to ex1 in the horizontal direction and by an amount equal to ey1 in the vertical direction with respect to a center Oj of each of the bearings. If the pump is operated in this condition, the gear teeth tips of the gear 3 are rotated with a radius of RgO around the deflected center Og1 against the inner surface of the casing 5 whose inner radius is Rb around the center Oj, adjacent the low pressure port 12 at the meshing area of the gears 3 and 4. Therefore, the inner surface of the casing 5 is cut as $\epsilon$. When the pump is driven in the same condition, the gear teeth tips of the gear will slide on the casing 5 over the inner section S cut out of the casing 5 with an appropriate clearance to provide an oil seal.

Further, referring to FIG. 9, after the tooth tip 3*a* of the gear 3 is assembled with the inner surface of the casing or case body 5 to provide a uniform and appropriate clearance So, the "running-in-operation" is performed. After the "running-in-operation" as shown in FIG. 10, a portion of the case body 5 is selectively worn by sliding, so that eventually the case body 5 is worn in an arcuate shape with the greatest wear being at the central portion. After the "running-in-operation", if this pump or motor is used for high pressure operation, the gear 3 may be bent a relatively large amount as compared with the size of the case body 5 in response to the high pressure of the oil from the center of the side. In such a case, the clearance $\beta$ between the tooth tips 3*a* of the gear 3 at the ends and the inner surface of the case body 5 becomes very small as shown in FIG. 11. In conclusion, the clearance between the tooth tips 3*a* of the gear 3 and the inner surface of the case body 5 will be inevitably altered after the inner working due to the "running-in-operation" and the bending at the barrel center of the gear 3 during the high pressure operation. No matter how high the measurement accuracy of the components of the gear pump or motor is when the components are selectively combined, it cannot be expected that a uniform and appropriate clearance is maintained at the tooth tips 3*a* of the gear 3 during the high pressure operation.

As stated above, when the operative conditions of the gear pump or motor alter, particularly the rotation speed of the gears and the operation temperature, even once the appropriate clearance of the gear tooth tips is selected by the "running-in-operation", the oil leakage at the tooth tips can be remarkably increased because the deflection positions of the gear can be changed frequently and the inner surface portions cut by the gear tooth tips can be shifted also to thereby increase the gear tooth tip clearance.

As shown in FIG. 12, the gear 3 is supported by the journal bearing 8 in which the axis center of the gear 3 is deflected to be Og1 during low speed rotation and Og2 during high speed rotation with respect to the axis center Oj of the bearing 8. Where the axis center of the gear 3 is deflected because of an operational condition, the tooth tip 3*a* of the gear 3 cut the inner surface of the case body 5 in an inner radius Rg1 when the axis center of the gear 3 is Og1 and another inner radius Rg2 when the axis center of the gear 3 is Og2. In either of the deflection cases, the tooth tips 3*a* produce an excess clearance to thereby increase the oil leakage. Within the case body 5 having the inner radius of Rb, the tooth tips 3*a* cut a section B of the inner surface of the case body 5 in the low speed rotation, the section B being close to the low pressure port 12, and the tooth tips 3*a* cut another section C of the inner surface of the body 5 in the high speed rotation, the section C being far from the low pressure port 12.

In addition to the above-described disadvantageous result, the face of the inner surface of the case body which has then cut becomes rough and damages the volumetric pump efficiency.

SUMMARY OF THE INVENTION

With the foregoing in mind, it is an object of the present invention to provide an improved gear pump or motor with high capacity and efficiency.

It is another object of the present invention to provide an improved gear pump or motor with good oil seal structure.

It is a further object of the present invention to provide an improved case body of a gear pump or motor comprising a hard material layer for grinding a gear.

Other objects and further scope of applicability of the present invention will become apparent from the detailed description given hereinafter. It should be understood, however, the the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a gear pump or motor comprises a pair of gears intermeshing with each other, a case body accommodating the pair of gears, and a hard layer formed on an inner surface of the case body. The hard layer is made of a material sufficiently hard so as not to be cut by the tooth tips of the pair of gears. The hard layer may be a ceramic coating layer or a composite coating layer.

BRIEF DESCRIPTION OF THE DRAWINGS

The present invention will become more fully understood from the detailed description given hereinbelow and accompanying drawings which are given by way of illustration only, and thus are not limitative of the present invention and wherein:

FIGS. 9 through 11 are drawings of explaining the variations in the clearance between the tooth tip of a gear and a case body owing to the bending of the gear.

FIG. 13 is a view of a gear shaped according to the present invention.

DESCRIPTION OF THE PREFERRED EMBODIMENTS

Figure 1:
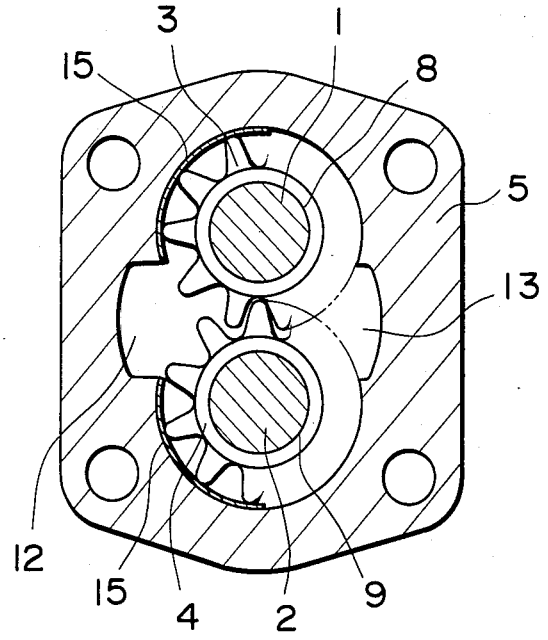
FIG. 1 is a vertical traverse sectional view of a typical form of a gear pump or motor embodying a first preferred embodiment of the present invention.
Figure 2:
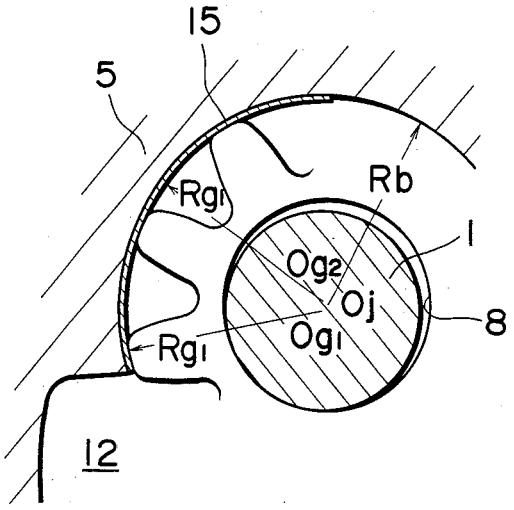
FIG. 2 is an enlarged sectional view of an oil seal at the tooth tips of a gear in FIG. 1.

FIGS. 1 and 2 show a gear pump or motor according to a first preferred embodiment of the present invention. Within a casing 5 having peripheral walls, a pair of gears 3 and 4 are intermeshed with their shafts 1 and 2 being supported by bearings 8 and 9. A low pressure port 12 is provided at one side of the meshing area while a high pressure port 13 is provided at the other side of the meshing area. A ceramic coating layer 15 is provided on about one quarter of the casing 5, adjacent to the low pressure port 12, which has an oil seal relationship with the gear tooth tips of each of the gears 3 and 4. Preferably, the thickness of the ceramic coating layer 15 is 10 to 30$\mu$. The ceramic coating layer 15 is provided so that when the tooth tips of the gears 3 and 4 slide on the ceramic coating layers 15 on the casing 5, the tooth tips are cut because the ceramic coating layers 15 are made of a material that is harder than the gear tooth tips. The ceramic coating layers 15 are machined to have appropriate roughness.

Upon operation of the above-arranged gear pump or motor, the gears 3 and 4 are rotated and are adjacent to the low pressure port 12, so that the gear tooth tips of the gears 3 and 4 slide on the ceramic coating layers. 15. The gear tooth tips of the gears 3 and 4 are cut by the ceramic coating layers 15 so as to produce the most appropriate clearance, as shown in FIG. 13, with each of the gears being shaped to have the diameter thereof become gradually smaller towards the central portion from both ends. Once the gear tooth tips are cut by the ceramic coating layers 15, this clearance can be kept between the gear tooth tips and the ceramic coating layers 15 even if the rotation center of the gears 3 and 4 is moved according to an oil pressure change within the bearings 8 and 9 based on changes in the operating conditions. Thus, there is no fear that the clearance between the gear tooth tips and the casing 5 will be enlarged because of the changes of the operating conditions as in the conventional case.

FIG. 2 shows an enlarged view of a portion of the ceramic coating layers 15. The portions of the casing 5 near to the low pressure port 12 cannot be cut because of the coating layer 15 and has a constant inner radius of Rb from its axis center Oj. On the contrary, the gear tooth tips of the gear 3 are cut to be a radius of Rg1 and can slide with a constant clearance against the ceramic coating layer 15 in either low speed rotation (the axis center is Og1) or high speed rotation (the axis center is Og2).

Because of the provisions of the ceramic coating layers 15, it is not possible under any operating condition that the clearance between the tooth tips of the gears and the inner surface of the casing 5 will be increased to thereby make the oil leakage through the gear tooth tips large. Regardless of the operating conditions, high capacity and efficiency can be continuously maintained. Because the casing 5 is not cut by the gear tooth tips, the material of the casing 5 has no effect upon the oil seal therebetween. The material of the casing 5 may be aluminum or a cast iron or the like. Since the gear tooth tips which have a narrow width are cut, the control of the cutting of the gear tooth tips is generally easier than the case of continuously cutting the peripheral portion of the inner surface of the casing 5. Where the gear tooth tips cut the inner surface of the casing 5, particularly where it is made of a cast iron, excess stress may be applied to the bearings 8 and 9. Because there is no possibility of such excess stress on the bearings 8 and 9 with the present invention, they can be simplified and have a long life.

Figure 3:
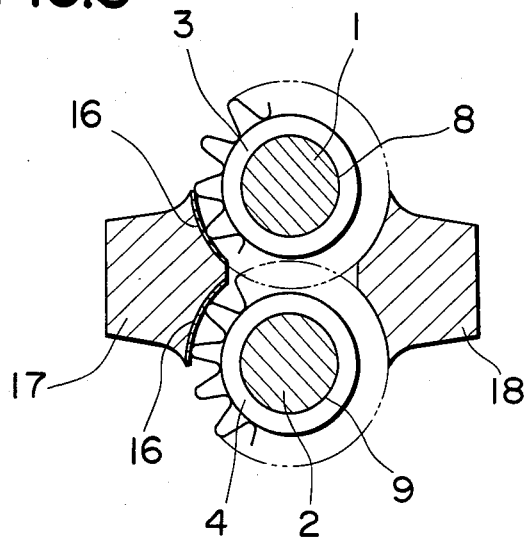
FIG. 3 is a central vertical longitudinal sectional view of another gear pump or motor embodying a second preferred embodiment of the present invention.
Figure 4:
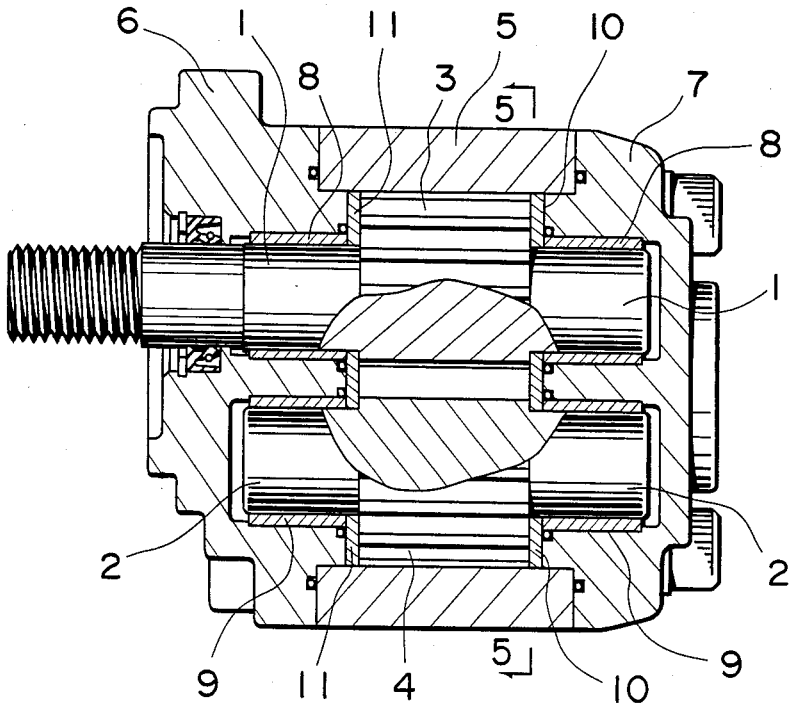
FIG.4 PRIOR ART
FIG. 4 is a central vertical longitudinal sectional view of a conventional gear pump or motor.
Figure 5:
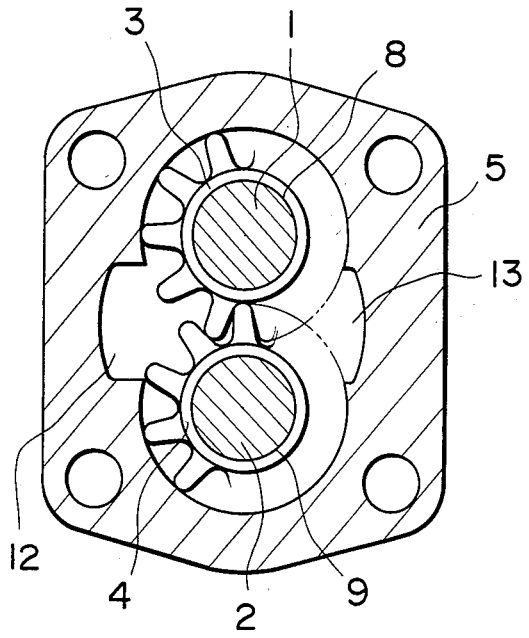
FIG. 5 PRIOR ART
FIG. 5 is a vertical longitudinal sectional view taken along the line 5—5 of FIG. 4.
Figure 6:
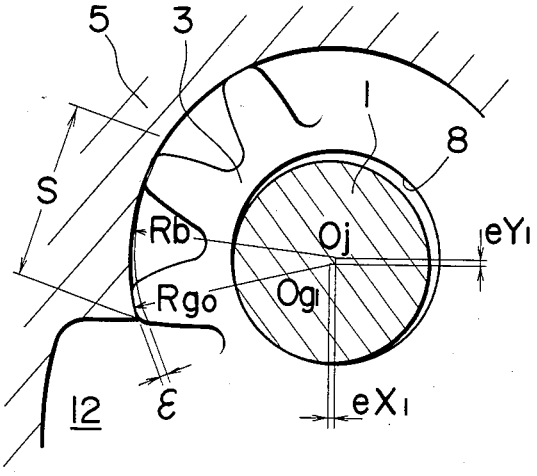
FIG. 6 PRIOR ART
FIG. 6 is an enlarged sectional view of a gear and a case body of FIG. 4.

FIG. 3 shows a second preferred embodiment of the present invention. This embodiment is in the form of a seal block type gear pump or motor as disclosed in Y. Kita, U.S. Pat. No. 3,309,997, entitled "Gear Pump or Motor", issued on Mar. 21, 1987. In this seal block type gear pump or motor, a pair of seal blocks 17 and 18 are provided whose openings are positioned in a low pressure port and a high pressure port as a low pressure side and a high pressure side adjacent to the meshing areas of the gears 3 and 4. The inner surface of the seal block 17 at the low pressure side is provided with ceramic coating layers 16. The tooth tips of the gears 3 and 4 slide on this inner surface 16 of the seal block 17. In FIG. 3, the casing enclosing the gears 3 and 4 is omitted from illustration. In the second embodiment of the present invention, the same results as in the first embodiment can be expected.

As described above, in accordance with the first and second preferred embodiments of the present invention, the ceramic coating layers 15 and 16 can be formed on any type of gear pump or motor as long as the ceramic coating layer is formed on the oil seal portion of the inner surface of the peripheral casing. Further, the material of the coating layers 15 and 16 should not be limited to ceramic material but any other hard material can be used. It may also be possible to make the casing itself of a hard material.

In a third preferred embodiment of the present invention, the ceramic coating layers 15 and 16 are replaced by a composite coating layer, similarly, formed on a portion which is approximately a quarter of the inner surface of the casing 5 adjacent the low pressure port 12. Preferably, the thickness of the composite coating layer 15 or 16 is 10 to 30.

Figure 7:
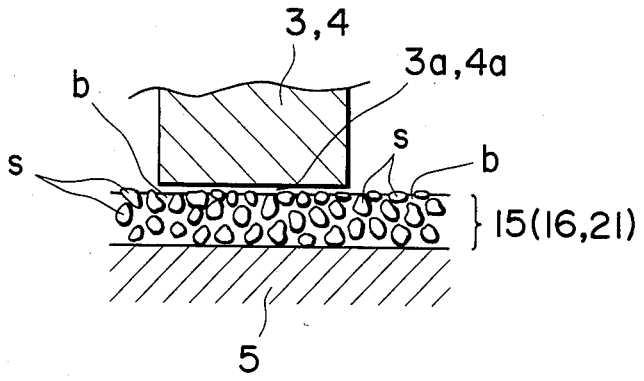
FIG. 7 is an enlarged sectional view of a composite coating layer used in a third preferred embodiment of the present invention.

FIG. 7 shows a sectional view of such a composite coating layer 15 or 16. It comprises hard ceramic particles s mixed within a soft bonding material b. The surface of the conposite coating layer 15 or 16 is formed by an appropriate grinding operation so that the ceramic particles s within the soft bonding material b can appear. Thus, the particles s can grind the surface of an opposing member as the ceramic particles s serve as whetstone particles. Each of the ceramic whetstone particles s is divided along a predetermined crystal plane according to the cleavage (broken) function provided by the regular cleavage plane. A preferred example of the composite coating layer 15 or 16 is a composite ceramic coating layer. This composite ceramic coating layer is formed by plating catalytic nickel generation on a suitable coating surface, in which SiC or $Al_2O_3$ particles correspond to the hard ceramic particles s. It has high abrasion-endurance hardness and excellent cleavage characteristics.

With the composite coating layer 15 or 16, the "running-in-operation" is carried out as a grinding operation, which is distinctly different from a cutting operation. More particularly, the peripheral speed of the gear tooth tips is limited to be under about 10–100 m/min in the cutting operation on the inner surface of the casing by the gear tooth tips. The peripheral speed of the gear tooth tips is as high as about 1200–4800 m/min in the grinding operation on the gear tooth tips by the inner surface of the casing. If the "running-in-operation" takes place above such a speed, friction heating is generated so that the tooth tips of the gear become closer to the casing thereby significantly damaging the fineness of the inner surface of the casing. For example, assuming the outer diamter of the gear is about 100 mm and the periphery is about 314 mm, even if the peripheral speed is about 100 m/min, the "running-in-operation" cannot take place over about 318 rpm. This value is much smaller than the speed during operation. The center of the gear is shifted depending on the rotation speed so that the gear tooth tips can be wiped on the inner surface of the casing and the inner surface of the casing becomes rough.

With the composite coating layer 15 or 18 on the inner surface of the casing 5, on the contrary, the "running-in-operation" can take place based on the grinding operation theory so that the surfaces of the composite coating layers 15 and 16 can grind the tool tips 3*a* and 4*a* of the gears 3 and 4 to thereby provide a clearance. In the "running in operation", the most appropriate clearance is provided according to the bending degree of the longitudinal side of the gears 3 and 4 and the tooth tips 3*a* and 4*a* of the gears 3 and 4 are uniformly ground over their whole periphery. Even if an operating condition, such as the rotation speed, varies and shifts the center of the gears, the most appropriate clearance can be continuously maintained. The tool tips 3*a* and 4*a* of gears 3 and 4 can oppose the inner surface of the case body 5. There can be no possibility that, depending upon the operating conditions of the pump or motor, the clearance is increased thereby reducing the oil seal characteristics. Additionally, the composite coating layer 15 or 16 provides the particular cleavage plane functioning in order to provide a sharp cut and the tooth tips 3*a* and 4*a* ground by the cleavage place have a smooth surface as though formed by plunge grinding. With the help of the surface condition at the oil seal face, provided the layer 15 or 16 oil can be prevented from leaking through the tooth tip portions, As compared with the conventional oil seal, the sliding oil seal face is free of the roughness due to the execution of the "running-in-operation", so that the oil leakage, in particular, in the high pressure operation can be remarkably reduced.

Further advantages of the present invention can be given as follows. Because the scraps of the tooth tips resulting from the grinding operation are very much finer than those made with the cutting operating on the inner surface of the casing body, they can be all eliminated in the "running-in-operation". There may be no possibility that, as is conventional, the scraps made with the wiping of the inner surface of the casing body are attached to the surrounding elements, such as the side plates, and cannot be eliminated, resulting in a malfunction owing to the attached scraps becoming detached in operation and proceeding into the oil pressure pipes.

Since the ceramic particles s of the composite coating layer 15 or 16 are a super hard material, the gears 3 and 4 ground by the ceramic particles s can be made of a cemented steel which is a hard material. No fine working of the elements are necessary in the present invention.

Figure 8:
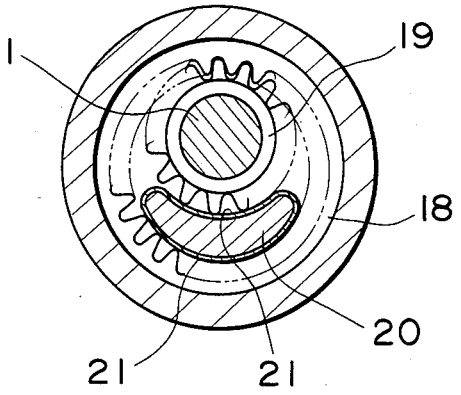
FIG. 8 is a vertical traverse sectional view of a gear pump or motor embodying a fourth preferred embodiment of the present invention.
Figure 12:
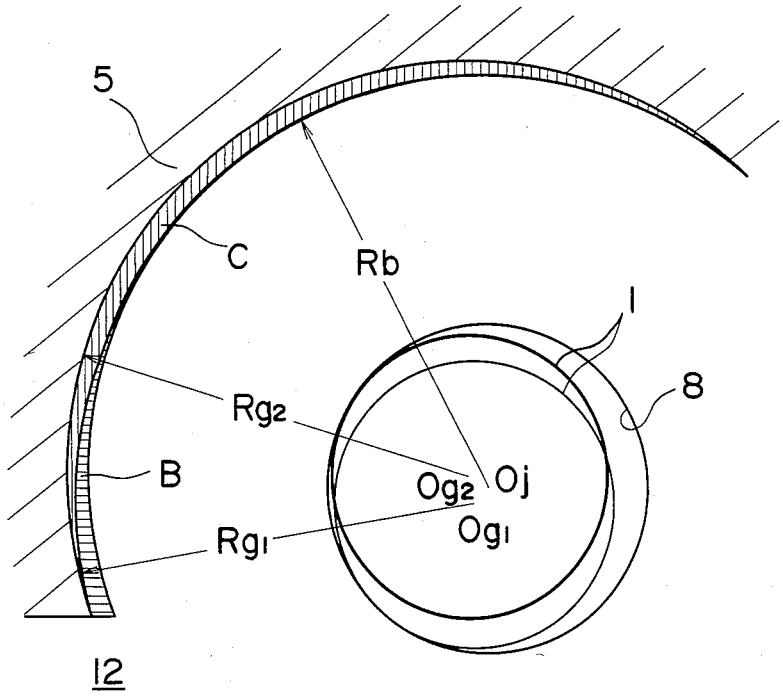
FIG.12 PRIOR ART
FIG. 12 is a drawing illustrating the changes in the portions of the case body cut by the tooth tips of the gear according to the variations of the axis center of the gear.

FIG. 8 shows a gear pump or motor according to a fourth preferred embodiment of the present invention. This gear pump or motor is an internal type comprising an outer gear 18, an inner gear 19, a separating plate 20 interposed between the gears 18 and 19 for sealing the high pressure side and the low pressure side, and composite coating layers 21 provided on the outer surface and the inner surface of the separating plate 20. Each of the composite coating layers 21 has the construction of the layers 15 and 16 as shown in FIG. 7. Further, each of the composite layers 21 may be made of a ceramic coating layer as described in the first and the second preferred embodiments of the present invention.

As described above, in accordance with the third and the fourth preferred embodiments of the present invention, the composite coating layer can be formed on any type of gear pump or motor as long as the composite coating layer is formed on the oil seal portion of the inner surface of the peripheral casing with the gears. For example, the composite coating layer can be formed on the inner surface of the side plate for sealing the sides of the gears, so that the oil can be prevented from leaking through the sides of the gears according to a principle similar to the above-described principle.

The soft bonding material b, nickel, can be replaced by any other metal or any synthetic resin. The material of the ceramic particle s, SiC or $Al_2O_3$, serving as the grinding or whetstone particles, can be selected to be any other element so long as it is hard and provides a good grinding function with the cleavage characteristics. In place of the electroless plating, the composite coating layer can be formed with any other physical of chemical methods.

In accordance with the third and the fourth preferred embodiments of the present invention, the composite coating layer is provided on the inner surface of the casing body for grinding the gears to thereby provide the most appropriate clearance between the peripheral casing body and the gears by grinding the gear teeth. The set clearance is not remarkably changed depending on the operating conditions of the gear pump or motor. The front surface of the composite coating layer serving as the grinding tool is the clearance plane, so that the ground face of the gear shows the smooth process surface. The thus improved surface of the wiping face can reduce the oil leakage, remarkably. In terms of the correlation between the cleavage plane and the smooth process surface, a high capacity and highly efficient gear pump or motor can be provided in the high pressure conditions.

The gist of the present invention lies in the technical solution that the gears are ground by the inner surface of the peripheral element of the casing body. When the tooth tips of the gear wipe the inner surface of the casing body, the ceramic coating layer or the composite coating layer with relatively super hardness and abrasion endurance can grind the gear teeth and provide the most proper clearance. Since the tooth tips of the gears are ground to adjust the clearance, even if the gears are bent along with the fixed axis center of the gear or the axis center is shifted because of the operating conditions of the gear pump or motor, the tooth tips of the gears will be ground so as to compensate for the bending and the shift. The gears can continuously oppose the inner surface of the case body with the most proper clearance. It is to be noted that, when tooth tips of the gears are ground by the composite coating layer, the smooth ground face of the gear tooth tips is machined in a manner which improves the oil seal characteristics remarkably. For this purpose, the hard ceramic particles within the composite coating layer grind the tooth tips of the gear as grinding or whetstone particles during the "running-in-operation", as in a grinding operation. The surface of the composite coating layer is provided with a cleavage plane of the ceramic particles found by the soft bonding member while the tooth tips of the gears ground by the cleavage plane are a beautiful process plane distinctly different from that obtained by the cutting operation on the inner surface of the case body by the gear tooth tips. The improvement of both the cleavage plane and the beautiful process plane provide a very good oil seal function to the wiping surface.

While only certain embodiments of the present invention have been described, it will be apparent to those skilled in the art that various changes and modifications may be made therein without departing from the spirit and scope of the invention as claimed.

What is claimed is:

1. A high pressure gear pump or motor comprising:

a casing having an internal cavity therein, a pair of intermeshing gears located in said cavity, a hard layer formed only on portions of said internal cavity, each of said gears having teeth with tips, a center portion and two ends, shaft means secured to each of said gears at said two ends thereof for supporting each of said gears in said cavity, said hard layer being made of a material harder than said gear teeth tips, each of said gears being shaped to have the diameter thereof become gradually smaller towards the central portion from both said ends by said hard layer grinding said tips of said gears when rotating, so as to make an appropriate clearance between said casing and said gears in operation to seal leakage of a fluid.

2. The gear pump or motor recited in claim 1, wherein, a low pressure port and a high pressure port are located in said housing, said internal cavity includes two annular areas receiving said gears, and said hard layer is made up of coatings extending approximately one quarter of the way around each annular area.

3. The gear pump or motor recited in claim 2, wherein said coatings are positioned adjacent said low pressure port.

4. The gear pump or motor according to claim 1, wherein said hard layer is a ceramic coating layer.

5. The gear pump or motor according to claim 1, wherein said hard layer comprises hard ceramic particles mixed within a soft bonding material.

6. The gear pump or motor according to claim 5, wherein said hard layer comprises nickel bonding metal of catalytic generation with ceramic particles mixed therein, and said nickel bonding metal being baked and hardened to provide a composite coating layer.

7. The gear pump or motor according to claim 6, wherein said particles are SiC.

8. The gear pump or motor according to claim 6, wherein said particles are $Al_2O_3$.

9. The gear pump or motor according to claim 4, wherein said hard layer has a thickness of 10 to 30$\mu$.

10. The gear pump or motor according to claim 1, wherein said gear pump or motor is a seal block type.

11. The gear pump or motor according to claim 1, wherein said gear pump or motor is an internal type.

* * * * *